US006729416B2

(12) United States Patent
Contreras et al.

(10) Patent No.: US 6,729,416 B2
(45) Date of Patent: May 4, 2004

(54) METHOD AND APPARATUS FOR RETAINING A CORE SAMPLE WITHIN A CORING TOOL

(75) Inventors: Gary W. Contreras, Valencia, CA (US); Edward Harrigan, Richmond, TX (US); Bunker M. Hill, Sugar Land, TX (US); Robert W. Sundquist, The Woodlands, TX (US); Dean W. Lauppe, Pasadena, TX (US); Sony Tran, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 78 days.

(21) Appl. No.: 09/832,606

(22) Filed: Apr. 11, 2001

(65) Prior Publication Data

US 2002/0148643 A1 Oct. 17, 2002

(51) Int. Cl.[7] ..... E21B 10/02
(52) U.S. Cl. ..... 175/20; 175/58
(58) Field of Search ..... 175/58, 20, 244–255

(56) References Cited

U.S. PATENT DOCUMENTS

| | | | | |
|---|---|---|---|---|
| 366,913 A | * | 7/1887 | Ball | 175/237 |
| 2,181,980 A | | 12/1939 | Seale | |
| 2,343,793 A | * | 3/1944 | Paget | 175/249 |
| 3,092,192 A | * | 6/1963 | Deely | 166/70 |
| 4,354,558 A | | 10/1982 | Jageler et al. | |
| 4,607,710 A | * | 8/1986 | Radford | 175/249 |
| 4,714,119 A | | 12/1987 | Hebert et al. | |
| 4,969,528 A | | 11/1990 | Jurgens | |
| 4,996,872 A | | 3/1991 | Mueller et al. | |
| 5,025,872 A | | 6/1991 | Behre et al. | |
| 5,052,502 A | | 10/1991 | Jurgens et al. | |
| 5,105,894 A | | 4/1992 | Enderlin | |
| 5,146,999 A | | 9/1992 | Wiser et al. | |
| 5,163,522 A | | 11/1992 | Eaton et al. | |
| 5,230,390 A | | 7/1993 | Zastresek et al. | |
| 5,310,013 A | | 5/1994 | Kishino et al. | |
| 5,360,074 A | | 11/1994 | Collee et al. | |
| 5,411,106 A | | 5/1995 | Maissa et al. | |
| 5,439,065 A | * | 8/1995 | Georgi | 175/59 |
| 5,487,433 A | | 1/1996 | Mackay et al. | |
| 5,546,798 A | | 8/1996 | Collee et al. | |
| 5,560,438 A | | 10/1996 | Collee et al. | |
| 5,568,838 A | | 10/1996 | Struthers et al. | |
| 5,617,927 A | | 4/1997 | Maissa | |
| 5,667,025 A | | 9/1997 | Haessly et al. | |

(List continued on next page.)

FOREIGN PATENT DOCUMENTS

| | | |
|---|---|---|
| GB | 2 236 780 A | 4/1991 |
| SU | 578430 | 5/1976 |
| SU | 1157220 | 5/1985 |
| SU | 1629468 | 2/1991 |

OTHER PUBLICATIONS

Baker Hughes INTEQ, *Coring Applications and Technology*, Advertising brochure (Aug. 1995).

*Primary Examiner*—Thomas B. Will
*Assistant Examiner*—Meredith Petravick
(74) *Attorney, Agent, or Firm*—Jennie (JL) Salazar; Brigitte L. Jeffrey; John J. Ryberg

(57) ABSTRACT

A core sample retaining sleeve is provided for preventing loss of a cut core sample from the distal end of a coring bit, particularly during retraction of the coring bit to within the coring tool. Preferably, the core sample retaining sleeve is disposed concentrically within the coring bit to fit around the received core sample. The core sample retaining sleeve has one or more retaining fingers formed on the distal end of the coring bit. The retaining fingers are selectively closeable, preferably by urging the one or more retaining fingers against one or more guide members. A guide member is preferably provided as a stationary ridge on the inner, distal surface of the coring bit. The core sample is contained and protected within the closed retaining sleeve.

13 Claims, 7 Drawing Sheets

U.S. PATENT DOCUMENTS 5,741,707 A 4/1998 Herron et al.
5,868,030 A 2/1999 Brumley et al.
5,957,221 A 9/1999 Hay et al.
6,006,844 A 12/1999 Van Puymbroeck et al.
6,283,228 B2 9/2001 Collee et al.
6,341,656 B1 1/2002 Fanuel et al.
6,371,221 B1 4/2002 Harrigan et al.
6,378,631 B1 4/2002 Aumann et al.
6,394,196 B1 5/2002 Fanuel et al.
6,401,840 B1 6/2002 Hay et al.
6,412,575 B1 * 7/2002 Harrigan et al. ..... 175/20

* cited by examiner

FIG. 5
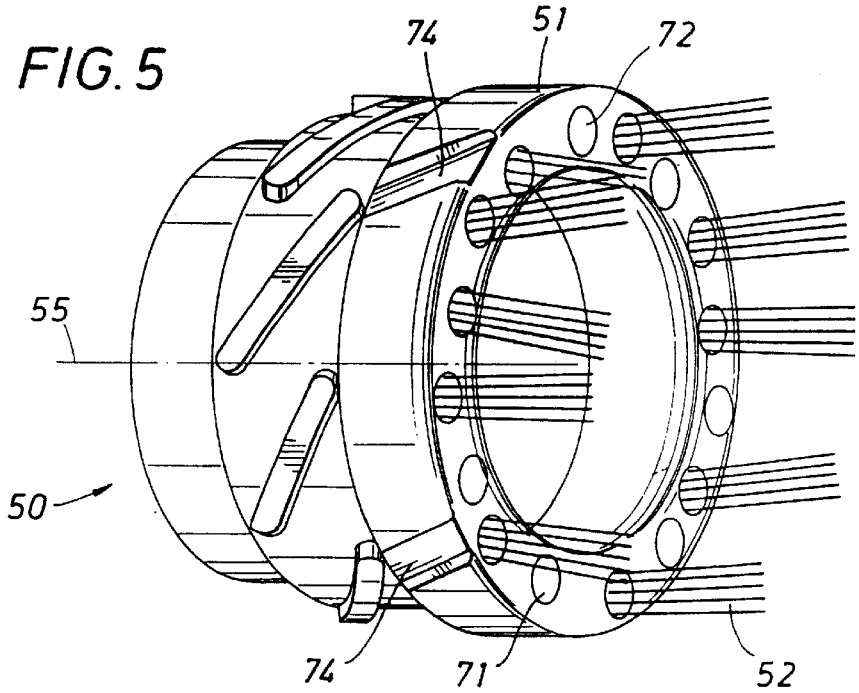
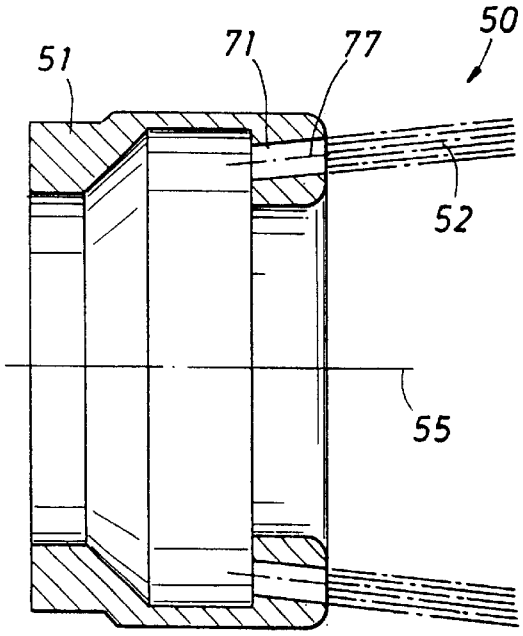
FIG. 6A
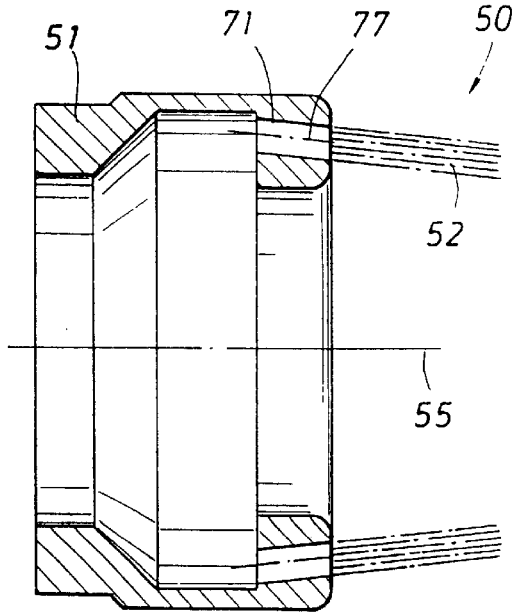
FIG. 6B

FIG. 10
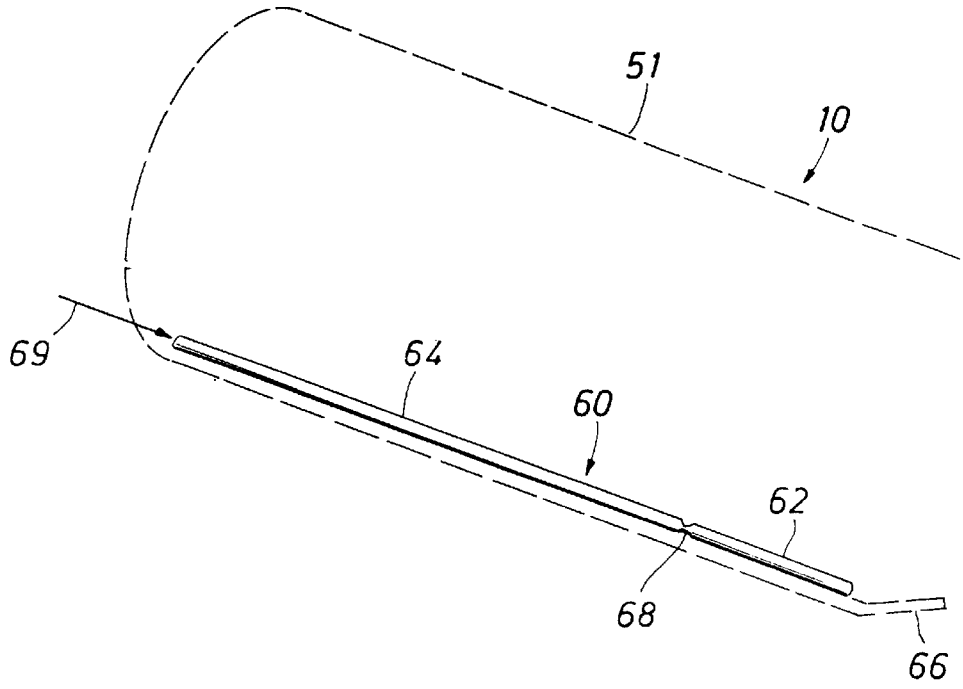
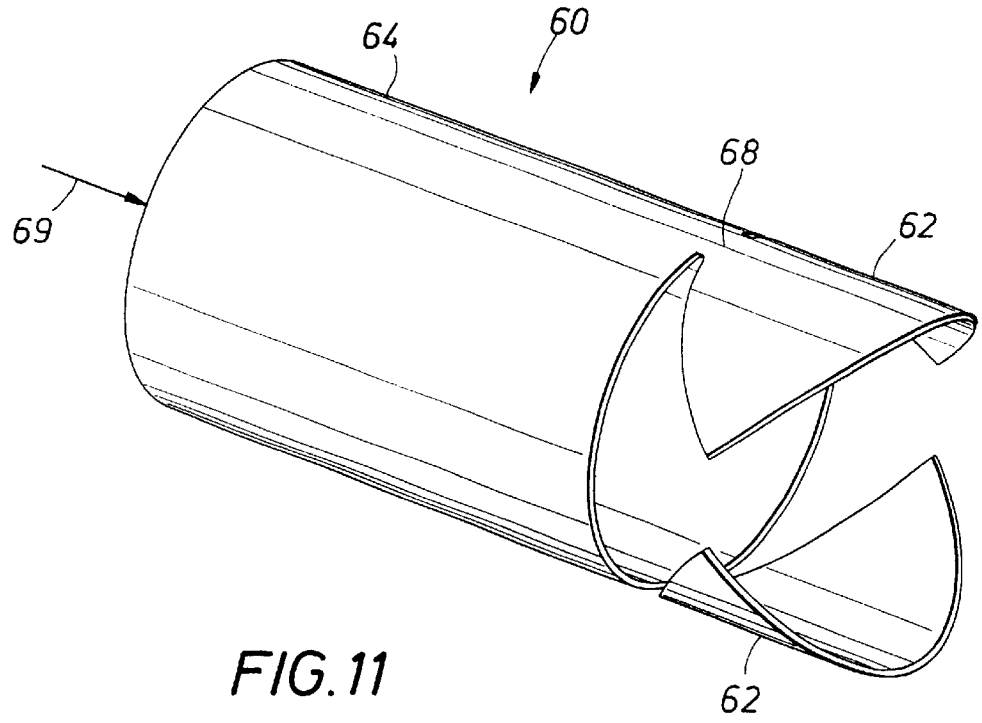
FIG. 11

METHOD AND APPARATUS FOR RETAINING A CORE SAMPLE WITHIN A CORING TOOL

FIELD OF THE INVENTION

The present invention relates to oil and gas well drilling equipment and methods of obtaining core samples.

BACKGROUND OF THE RELATED ART

Wells are generally drilled to recover natural deposits of hydrocarbons and other desirable, naturally occurring materials trapped in geological formations in the earth's crust. A slender well is drilled into the ground and directed to the targeted geological location from a drilling rig at the surface. In conventional "rotary drilling" operations, the drilling rig rotates a drillstring comprised of tubular joints of steel drill pipe connected together to turn a bottom hole assembly (BHA) and a drill bit that is connected to the lower end of the drillstring. During drilling operations, a drilling fluid, commonly referred to as drilling mud, is pumped and circulated down the interior of the drillpipe, through the BHA and the drill bit, and back to the surface in the annulus.

Once a formation of interest is reached in a drilled well, drillers often investigate the formation and the deposits therein by obtaining and analyzing representatives samples of rock at multiple locations in the well. Each representative sample is generally cored from the formation using a hollow coring bit, and the sample obtained using this method is generally referred to as a core sample. Once the core sample has been transported to the surface, it may be analyzed to assess the reservoir storage capacity (porosity) and the flow potential (permeability) of the rock material that makes up the formation, the chemical and mineral composition of the mineral deposits residing in the pores of the formation, and to measure the irreducible water content of the rock material. The information obtained from analysis of the sample is used to design and implement well completion; that is, to selectively produce certain economically attractive formations from among those accessible by the well. Once the driller has decided upon a well completion plan, all formations except those specifically targeted for production are isolated from the target formations, and the deposits within targeted formations are selectively produced through the well.

Several coring tools and methods of obtaining core samples have been used. Conventional coring occurs where the drillstring is removed from the wellbore and a rotary coring bit having a hollow interior for receiving the cut core sample is run into the well on the end of the drillstring. The core obtained using conventional coring is taken in the path of the drillwell; that is, the conventional coring bit is substituted in the place of the drill bit and the portion of the formation in the path of the well is sampled instead of ground up and removed from the well by the mud flow. Sidewall coring occurs where the core sample is taken from the bore wall of the drilled well.

There are generally two types or categories of sidewall coring tools, rotary and percussion. Rotary coring is generally performed by forcing an open, exposed end of a hollow cylindrical coring bit against the wall of the bore hole and rotating the coring bit against the formation. The coring tool is generally secured against the wall of the bore hole or well with the rotary coring bit oriented towards the opposing wall of the bore adjacent to the formation of interest. The coring bit is generally deployed from the coring tool and against the bore wall by an extendable shaft or other mechanical linkage that is also used to rotate the coring bit against the formation. The coring bit generally has a cutting edge at one end, and the coring tool generally imparts rotational and axial force to the coring bit through the shaft or other mechanical linkage to cut the core sample. Depending on the hardness and degree of consolidation of the target formation, the core sample may also be obtained by vibrating or oscillating the open and exposed end of a hollow bit against the wall of the bore hole or even by application of axial force alone. The cutting edge of the bit is usually embedded with carbide, diamonds or other hard materials with superior hardness for cutting into the rock portion of the target formation.

As the core sample is cut and the bit advances into the formation, the core sample is received within the hollow barrel of the coring bit. After the desired length of the core sample or the maximum extension of the coring bit is achieved, the core sample is generally broken from its remaining interface or connection with the formation by displacing the coring tool and, through displacement of the linkage used to extend and impart motion to the coring bit, tilting the coring bit and the protruding core sample within the bit from their cored orientation. The core sample is usually broken free at the remaining interface with the formation by displacement of the coring tool within the wellbore, thereby imparting a breaking moment to the core sample through the coring bit. After the core sample is broken free from the formation, the hollow coring bit and the core sample received within the barrel of the coring bit are retrieved into the coring tool through retraction of the coring shaft or mechanical linkage that is used to deploy the coring bit to, and to rotate the coring bit against, the formation. Once the coring bit and the core sample have been retracted to within the coring tool, the retrieved core sample is generally ejected from the coring bit to allow use of the coring bit for obtaining subsequent samples at the same or other formations of interest. When the coring tool is retrieved to the surface, the recovered core sample is transported within the coring tool for analysis and tests. The present invention is designed for use with this type of coring process.

The second common type of coring is percussion coring. Percussion coring uses cup-shaped percussion coring bits that are propelled against the wall of the bore hole with sufficient force to cause the bit to forcefully enter the rock wall such that a core sample is obtained within the open end of the percussion coring bit. These bits are generally pulled from the bore wall using flexible connections between the bit and the coring tool such as cables, wires or cords. The coring tool and the attached bits are returned to the surface, and the core samples are recovered from the percussion coring bits for analysis.

The retrieval and analysis of core samples in their undamaged condition provides valuable geologic information that improves analysis and reservoir management. There are some problems with conventional coring equipment that result in loss or damage to core samples, and a related loss of valuable information.

Throughout the process of cutting and retrieval of the core sample using conventional coring equipment, the open end of the coring bit remains open. Unfortunately, the core sample is often lost through the open end of the coring bit while the coring bit and the core sample are being retrieved to within the coring tool. This risk of loss of the cut core sample from the open end of the coring tool is increased when the cutting zone from which material is removed during the cutting process is larger, as may result using non-conventional coring bits, such as with brush bits comprising a plurality of rigid bristles used to cut the formation.

Also, the coring process itself can cause damage to the core sample during coring and after it is broken free of the formation face. In the process of applying a breaking moment to the core sample to break it free of the formation, the core sample is often broken too far from the interface with the formation, resulting in a shorter and less useful core sample. Also, the core sample may be broken and eroded by "tumbling" within the hollow barrel of the rotating coring bit. Unconsolidated core samples may be damaged upon mechanical ejection from the coring bit to storage bins within the coring tool, or even upon removal from the storage bins at the surface.

What is needed is a device and method of breaking the core sample free from the formation without the necessity of displacement of the entire coring tool and without imparting excessive force to the linkage that extends and rotates the coring bit. What is needed is a device that secures the cut core sample within the coring bit to prevent loss of the cut core sample from the open end of the coring bit during the retrieval stage of the coring process. What is needed is a device that enables drillers to obtain a greater quantity of cut core samples in close to their original, undamaged conditions. It is preferred that the device and method of improving recovery of cut core samples be useful with existing coring tools.

SUMMARY OF THE INVENTION

The present invention provides a core retaining sleeve for improved recovery and retention of core samples from subsurface geologic formations, and a method of recovering cut core samples cut from a subsurface geologic formation. The core retaining sleeve uses one or more retaining "fingers" which, when deployed, impose one or more obstacles preventing loss of the cut core sample from the open end of the hollow interior of the coring bit. The core retaining sleeve is designed to reside within or around the coring bit without interfering with the cutting process of the coring bit during cutting of the core sample, and to be deployed radially outwardly from the well center to its retaining position. As the core retaining sleeve is deployed to capture the core sample, the retaining finger(s) are actuated to sever the core sample from the formation or to obstruct the loss of the core sample from the open end of the coring bit if the core sample is already severed. The core sample is thereby trapped within the hollow interior barrel of the coring bit by the actuated retaining finger(s) of the core retaining sleeve thereby preventing loss of the core sample from the open end of the coring bit during retrieval of the coring bit and the core sample to within the coring tool. The core retaining sleeve may remain stationary relative to the coring bit or it may rotate with the coring bit. Optionally, the core retaining sleeve may have internal or external grooves or channels to assist in removal of cuttings and debris or to impart a secondary reaming or boring effect to the brush bit.

The present invention also provides a tilting wedge that, when deployed against the proximal (coring tool) end of a cut core sample, imparts a breaking moment to the cut core sample sufficient to break it free from the remaining interface with the formation. Optionally, the tilting wedge may provide for improved retention of the core sample within the coring tool to prevent loss during retraction of the core sample to within the coring tool.

The present invention also relates to an apparatus for obtaining a core sample comprising a coring bit, a core retaining sleeve and an actuator. The coring bit has an interior wall and one or more stationary guide members formed on the distal end of the interior wall. The core retaining sleeve is in concentric alignment within the coring bit, the sleeve having one or more closeable retaining fingers at a distal end and defining a chamber for storing the core sample. The actuator forces the one or more closeable retaining fingers against the one or more stationary guide members to radially deflect the retaining fingers to a closed position. The apparatus may have a plurality of core retaining sleeves, or at least one core retaining sleeve. The apparatus may further include means for selectively positioning each of the core retaining sleeves within the coring bit to obtain a different core sample.

The present invention also relates to a method for obtaining a core sample. The method comprises cutting a core sample in a sidewall of a wellbore, disposing a core retaining sleeve around the core sample; detaching the core sample from the sidewall, and capturing the core sample within the core retaining sleeve. The method may further comprise repeating the steps at other locations in the wellbore using additional core retaining sleeves.

DESCRIPTION OF DRAWINGS

So that the features and advantages of the present invention can be understood in detail, a more particular description of the invention, briefly summarized above, may be had by reference to the embodiments thereof that are illustrated in the appended drawings. It is to be noted, however, that the appended drawings illustrate only typical embodiments of this invention and are therefore not to be considered limiting of its scope, for the invention may admit to other equally effective embodiments.

FIG. 5 shows a brush bit having non-rigid bristles.

FIGS. 6A and 6B show cross sectional views of a base of a brush bit having outwardly angled and inwardly angled bristles and holding channels, respectively.

FIG. 10 shows a single-finger type core sample retainer and integral push stem disposed along the interior wall of a coring bit prior to actuation.

FIG. 11 shows a clam-shell type core sample retaining sleeve and integral tubular push sleeve.

DETAILED DESCRIPTION OF THE INVENTION

Coring is a process of removing an inner portion of a material by cutting with an instrument. While some softer materials may be cored by forcing a coring sleeve into the material, for example soil or an apple, harder materials generally require cutting with rotary coring bits; that is, hollow cylindrical bits with cutting teeth or bristles disposed about the circumferential cutting end of the bit. Coring is used in many industries to either remove unwanted portions of a material or to obtain a representative sample of the material for analysis to obtain information about its physical properties. Coring is extensively used to determine the physical properties of downhole geologic formations encountered in mineral or petroleum exploration and development.

The meaning of "cutting", as that term is used herein, includes, but is not limited to, brushing, rubbing, scratching, digging, abrading and otherwise removing support from around the core sample. The meaning of "finger", as that term is used herein, includes, but is not limited to, a bendable but relatively rigid appendage. The meaning of "bristles", as that term is used herein, includes, but is not limited to, a plurality of stiff, slender appendages. The meaning of "stiff", as that term is used herein, includes, but is not limited to, firm in resistance or difficult to bend. "Slender" means little width relative to length. The meaning of "appendage", as that term is used herein, includes, but is not limited to, a part that is joined or attached to a principal object.

Figures 1, 2:
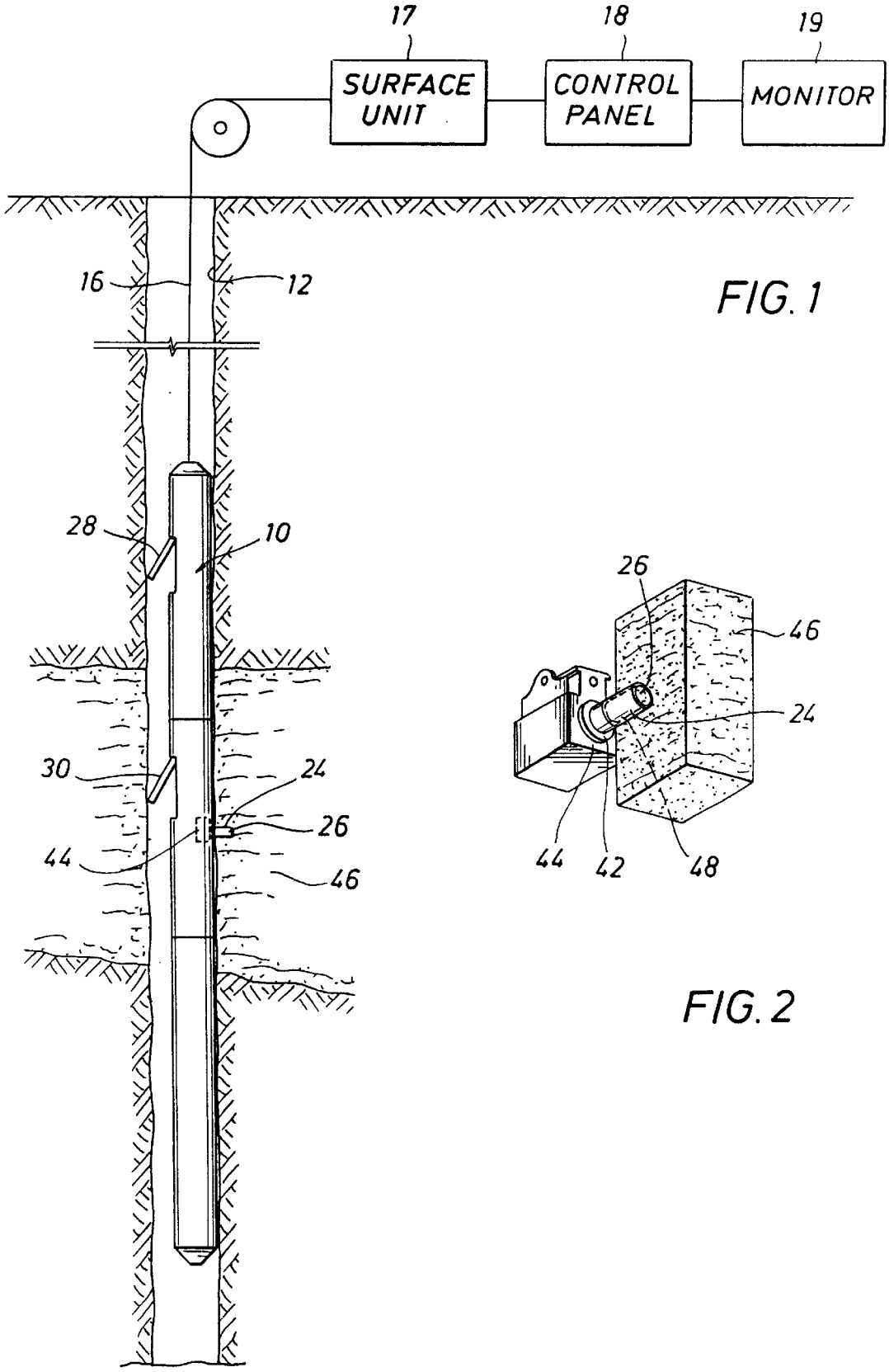
FIG. 1 shows the general configuration of a coring tool in use in a drilled well.
FIG. 2 shows a coring bit extended from a coring tool and cutting a core sample from a target geologic formation.

FIG. 1 shows the general configuration of equipment used in coring downhole geologic formations. The coring tool 10 is lowered into the bore hole defined by the bore wall 12, often referred to as the side wall. The coring tool 10 is connected by one or more electrically conducting cables 16 to a surface unit 17 that typically includes a control panel 18 and a monitor 19. The surface unit is designed to provide electrical power to the coring tool 10, to monitor the status of downhole coring and activities of other downhole equipment, and to control the activities of the coring tool 10 and other downhole equipment. The coring tool 10 is generally contained within an elongate housing suitable for being lowered into and retrieved from the slim bore hole. The coring tool 10 contains a coring assembly generally comprising a motor, a coring bit 24 having a distal, open end 26 for cutting and receiving the core sample, and a mechanical linkage for deploying and retracting the coring bit from and to the coring tool 10 and for rotating the coring bit against the side wall.

FIG. 1 also shows the coring tool 10 in its active, cutting configuration. The coring tool 10 is positioned adjacent to the target geologic formation 46 and secured firmly against the side wall 12 using anchoring shoes 28 and 30 extended from the opposing side. The distal, open end 26 of the coring bit 24 is rotated against the target geologic formation to cut the core sample.

FIG. 2 shows a closer view of the coring bit 24 after it has cut into the target geologic formation 46. The coring bit 24 is fixedly connected to a base 42 which is, in turn, connected to and turned by a coring motor 44. The core sample 48 is received into the hollow interior of the coring bit 24 as cutting progresses.

Conventional coring bits used in rotary cutting of core samples from downhole geologic formations are generally constructed of very rigid materials, steel teeth for example, and often have particles of very hard materials embedded in the circumferential cutting edge of the bit. These hard materials are designed to cut a circumferential groove around a core sample. The core sample is generally approximately 1 inch in diameter and the coring bit usually cuts approximately 1 to 2 inches into the formation side wall, thereby creating a protruding cylindrical core sample that can be broken from the formation and retrieved to the surface for analysis. It should be noted that the actual size of a core sample may vary widely and is not a limitation of the present invention.

Many formations are made of hard, consolidated rock, and these conventional rotary coring bits perform well in cutting core samples from these types of formations; that is, the core samples that are cut and retrieved provide the driller with valuable information such as porosity, permeability and content of the targeted formation. However, some mineral-bearing geologic formations are made of softer, unconsolidated rock comprising small hard rock particles held in a fixed relationship within a softer rock matrix. Unconsolidated core samples are often so fragile that they may crumble upon handling by human hands. Core samples recovered from unconsolidated formations using conventional rigid coring bits are often fractured and damaged as a result of the cutting action of the coring bit and the forces imparted to the geologic formation by the coring process. Fractured or damaged core samples obtained from unconsolidated formations typically provide very poor representations of the geologic properties of the formations from which they are obtained. Consequently, drillers may make inappropriate or less effective decisions in the completion phase of a well due to the lack of reliable geologic data.

While the present invention is applicable to coring both consolidated and unconsolidated formations, it has particular applicability to coring of unconsolidated formation because core samples obtained from unconsolidated formations are generally more susceptible to being damaged during the coring and recovery process. A brush bit particularly suited to coring unconsolidated is described in another invention assigned to the assignee of the present invention. To best understand the advantages provided by the present invention, it is important to understand some of the same mechanics of the coring process that affect the brush bit.

Figure 3:
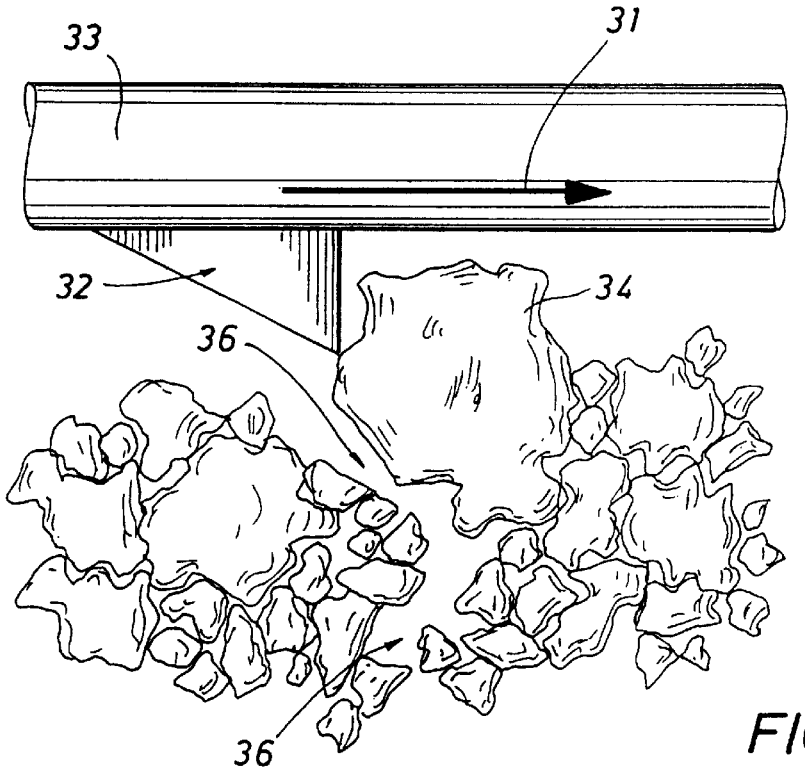
FIG. 3 shows the crushing force imparted by a rigid prior art coring bit and the resulting damage to the core sample of an unconsolidated formation.

FIG. 3 is a depiction of the interaction between a hard cutting tooth 32 of a conventional coring bit and the components 34 and 36 of an unconsolidated formation, and the fracturing of the core sample that results from this interaction. The hard cutting tooth 32 is embedded in the circumferential cutting edge 33 of the coring bit. The tooth 32 engages the formation as determined by the direction 31 of the localized portion of the cutting edge 33 of the coring bit. The moving tooth 32 forcefully engages a small, hard rock particle 34 that is held within the softer formation matrix 36. Instead of breaking or crushing upon impact by the tooth 32, the small, hard rock particle 34 is displaced by the force of the tooth 32, and the force exerted by the tooth 32 is transferred through the hard rock particle 34 to the surrounding softer formation matrix 36. The force transferred from the tooth 32 to the matrix 36 through the small, hard rock particle causes the matrix to severely fragment, separate, mobilize, disengage, or crush. The fragmentation and crushing of the formation matrix physically damages the core sample, thereby irreversibly compromising the geologic data available to the driller through analysis of the retrieved core sample.

Figure 4:
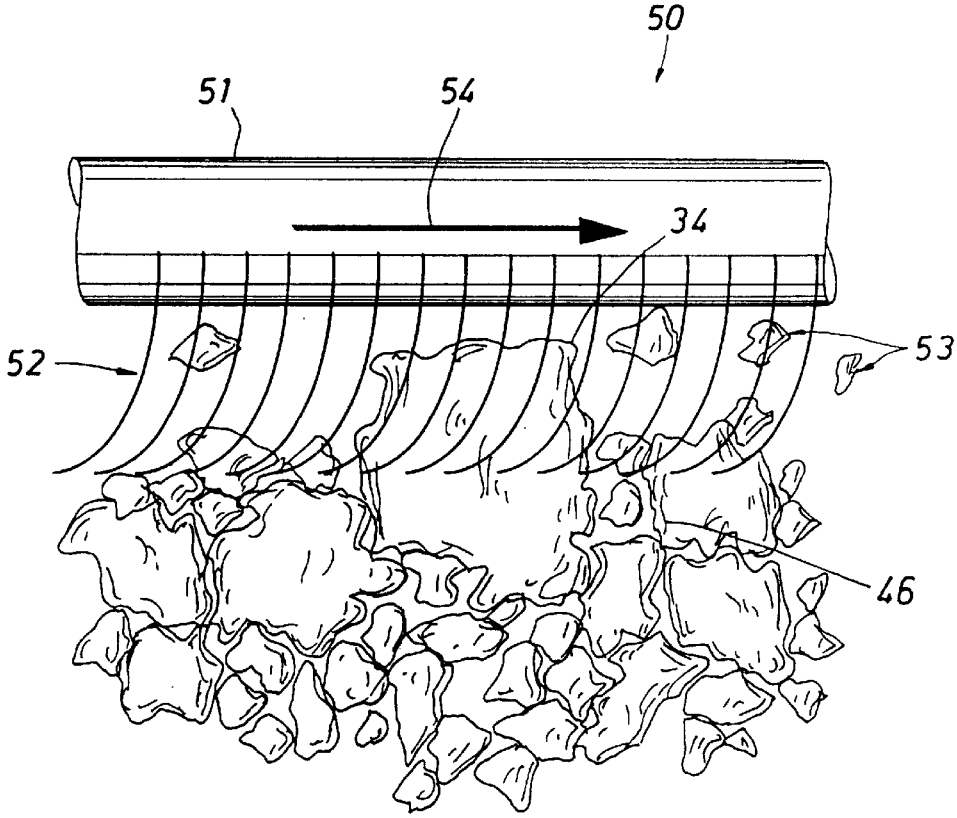
FIG. 4 shows the brushing action of non-rigid bristles used to cut a core sample from an unconsolidated formation.

FIG. 4 depicts the mechanics of how the brush bit interacts with an unconsolidated formation to reduce or eliminate damage to the core sample. The brush bit 50 better preserves core samples by using bristles 52 moving in direction 54 to contact, mobilize and remove small particles 53 from the soft rock matrix that surrounds harder rock particles 34 held therein. This leaves the harder rock particles 34 free for removal from the cutting zone without the fragmentation and damage to the adjacent core sample that occurs with conventional, rigid coring bits.

FIG. 5 shows an embodiment of the brush bit 50 having stiff bristles 52 disposed within receptacles 71 within the base 51 arranged in a circular pattern. The brush bit 50 has an interior space, cavity, channel, bore or passage for receiving the core sample cut by the bristles 52. FIG. 5 shows many of the bristles 52 of brush 50 removed from a subset of the receptacles 71 for illustration purposes only. The bristles 52 of the brush bit 50 may have a diameter ranging from 0.01 to 0.2 inches, but preferably in the range from 0.05 to 0.12 inches. The bristles 52 may comprise individual strands of wire or other stiff materials, but preferably comprise flexible cables comprising a number of bristles or strands braided together. The bristles 52 of the brush bit 50 may have a length ranging from 0.1 to 2.5 inches, but the bristle length is preferably in the range of 0.4 to 1.25 inches. The optimal length of the bristles 52 may depend on the stiffness of the material from which the bristles 52 are formed and the diameter of the brush bit 50. The bristles 52 may be of a variety of stiff materials that are chemically compatible with the fluids residing in the formations from which the core samples are cut and with the fluids used in drilling or completion of the well. The rotational speed of the brush bit may be from zero revolutions per minute for brush bits that are designed to operate using vibrations or oscillation to 5,000 revolutions per minute, but preferably in the range from 500 to 750 revolutions per minute.

A circular pattern is suitable for rotary brush bits such as that shown in FIG. 5 that are similar in operation to the conventional rigid bits in the prior art. Although the brush bit 50 may be rotated against the formation 46 like conventional rotary coring bits to cut the core sample, it may also be oscillated or vibrated against the formation to affect the desired mechanical cutting of the core sample. The brush bit 50 does not necessarily have to be cylindrical or circular in form. Even a brush bit designed for rotation about a central axis may have a non-circular cross section. The bristles 52 of the brush bit 50 may comprise wire, synthetic fibers, carbon or other materials capable of being fashioned into a stiff bristle. Furthermore, the brush bit may comprise any number of rows of bristles in various spacings, orientations and configurations.

FIGS. 6A and 6B are cross sectional drawings of FIG. 5 showing bristles 52 secured within receptacles 71 in the base 51 of the brush bit 50 at an angle to the axis 55 of the brush bit 50. FIG. 6A is a cross sectional drawing taken through receptacles 71 that are disposed a few degrees radially outwardly from the axis 55, and FIG. 6B is a cross sectional drawing taken through receptacles 71 that are disposed a few degrees radially inwardly from the axis 55. The outwardly and inwardly disposed bristles 52 and receptacles 71 are preferably distributed in a circular alternating pattern about the axis 55 of the brush bit 50 as shown in FIGS. 5, 6 and 8. The angle 77 formed by the base channel 71 to the axis 55 is in the range from zero (for axially aligned bristles) to 45 degrees, but preferably in the range from zero to 10 degrees, most preferably about 5 degrees. The angular orientation of the bristles 52 imparted by the angled receptacles 71, in combination with the length of the bristles, provides increased width to the cutting zone from which material is removed during the cutting of the core sample. This increased cutting zone width prevents interference between the base 51 and either the core sample or the formation when the core sample is being cut and received within the hollow interior of the coring bit 50.

Figure 7:
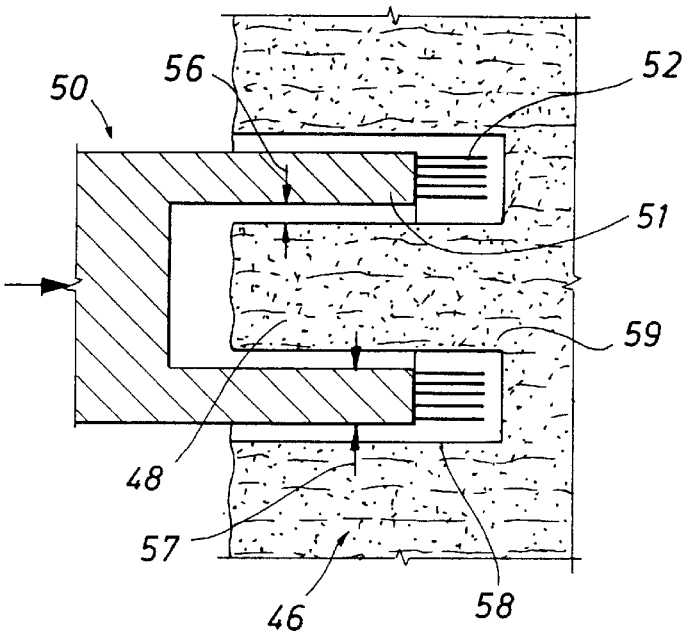
FIG. 7 shows a brush bit cutting a core sample from a target geologic formation.

The present invention provides a device for breaking a cut core sample free from the formation from which it is cut. A core sample is cut beginning at the sidewall of the well and progressing outwardly from the bore wall into the formation. FIG. 7 shows that, after the cutting is completed, the core sample 48 is in the form of a cylindrical piece of the formation protruding into the interior portion of the coring bit. The cut core sample 48 may remain attached to the formation at its distal end 59 to the formation from which it is cut until it is broken free of the formation. Typically, there will be a gap 56 between the exterior cylindrical surface of the cut core sample 48 and the interior wall of the coring bit 50 because the cutting zone 58, from which rock is removed during the cutting process, is generally wider than the wall thickness 57 of the coring bit 50. This gap 56 allows the cut core sample 48 to be broken free from the formation by eccentric displacement of the core sample 48 to the side of the interior of the coring bit 50, and is generally larger when the core sample is cut using a brush bit than it is when the core sample is cut using a conventional rotary coring bit. The larger the gap 56 (which results from a large cutting zone 58, the greater the risk of inadvertent loss of the cut core sample 48 during the process of retrieving the coring bit 50 and the cut core sample 48 to within the coring tool 10. For this reason, the use of the device and the method of the present invention is particularly advantageous for use in coring unconsolidated formations using a brush bit.

Figure 8A:
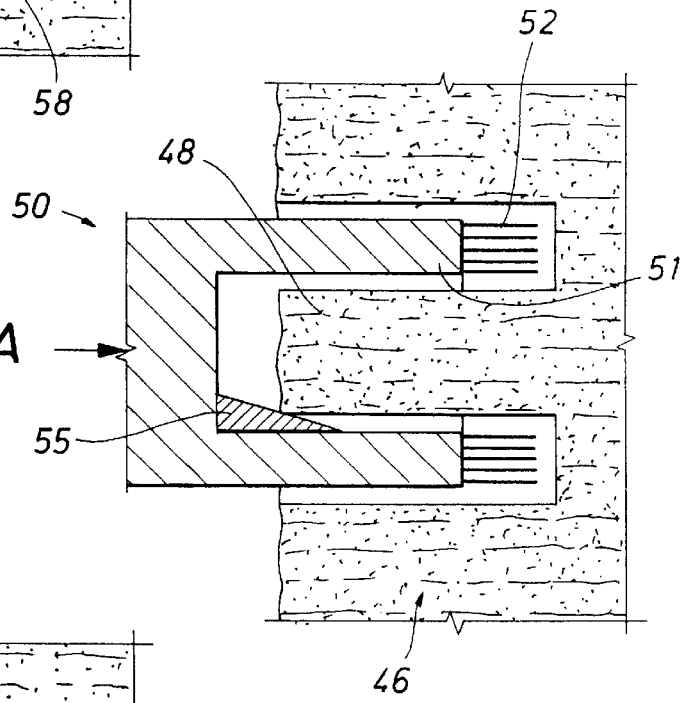
FIG. 8A shows a tilting wedge disposed within a rotary coring bit cutting a core sample prior to actuation of the tilting wedge against the cut core sample.

FIG. 8A shows a tilting wedge 55 of the present invention disposed within the base 51 of the coring bit 50. The tilting wedge is positioned against a point on the edge of the proximal face of the protruding core sample 48. The tilting wedge 55 may be integral to the coring bit 50, or it may reciprocate within a groove or guide in the interior wall of the base 51 of the coring bit 50. The tilting wedge 55 is actuated and thereby displaced towards the proximal end of the core sample 48 by a tilting wedge actuator that may be integral to the coring bit 50, or it may extend from the coring tool 10. The tilting wedge 55 may be actuated and forced against the edge of the proximal face of the protruding core sample 48 in a number of ways, including both linear actuation and rotational actuation. More specifically, the tilting wedge may be actuated by reversal of the direction of rotation of the coring bit 50, changing the axial direction of the coring bit 50, or by a deliberately large change in the magnitude of force against the coring bit 50 towards and against the formation side wall.

Figure 8B:
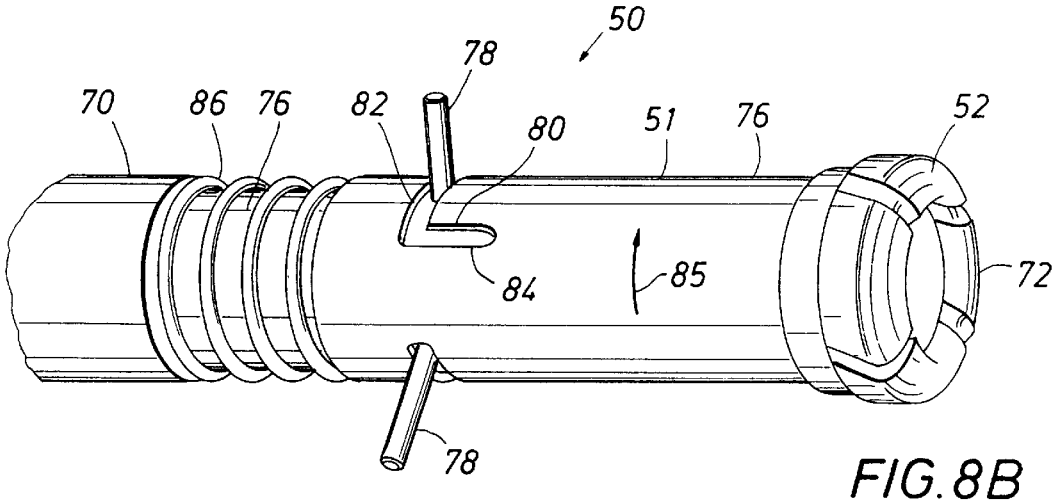
FIGS. 8B, 8C and 8D illustrate a tilting wedge actuated by reversing the rotation of the coring bit.
Figure 8C:
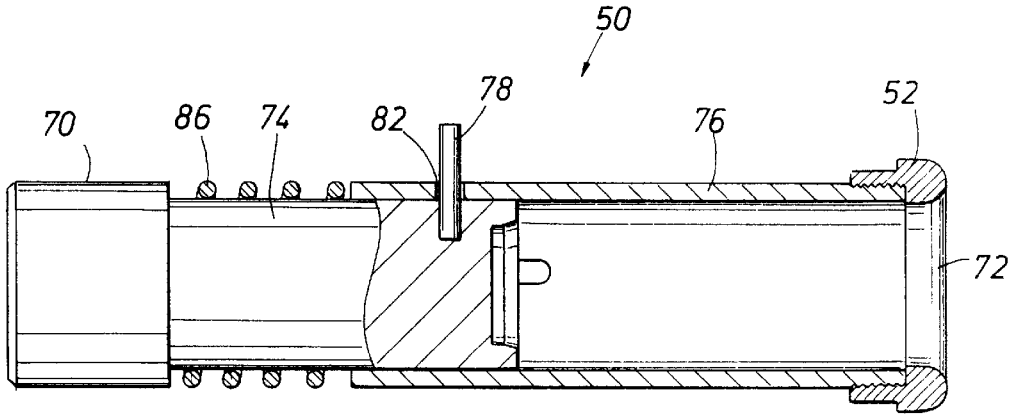
Figure 8D:
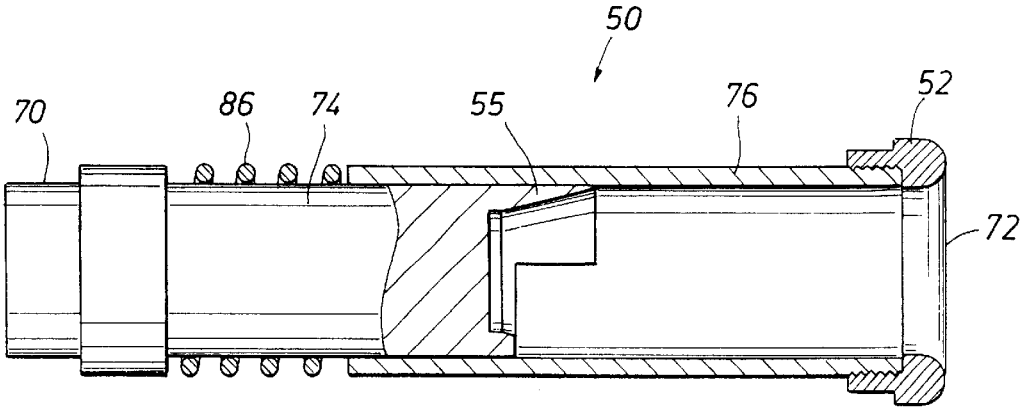

FIGS. 8B, 8C and 8D illustrate one embodiment having a tilting wedge 55 actuated by reversing the rotation of the coring bit 50. A proximal end 70 of the coring bit 50 comprises a first cylindrical shaft 74 coupled to the coring motor (See motor 44 in FIG. 2) and a distal end 72 of the coring bit 50 comprising a second cylindrical shaft 76 coupled to a brush bit or other cutting member 52. Preferably, the two shafts 74, 76 are concentrically aligned and have only a minimal gap therebetween in order maintain the concentric alignment and provide a telescoping configuration. The two shafts 74, 76 are coupled by one or more pin 78 rigidly secured to the shaft 74 and extending into or through an L-shaped slot 80 in the shaft 76. Preferably, the long leg 84 of the L-shaped slot 80 is generally axially aligned and the short leg 82 of the L-shaped slot is generally circumferentially aligned. Accordingly, an axial and circumferential force transmitted through the pin 78 causes the pin to ride within the circumferential leg 82 of the slot 80. After cutting the core sample, reversing the rotation of the bit 50 causes the pin 78 to slide along the leg 82 toward the leg 84. Applying an axial force sufficient to compress the spring 86, then causes the pin 78 to slide along the longer, axial portion 84 of the slot 80. This axial sliding allows the wedge 55 to extend into the core or sleeve to break the core sample free from the formation. Consequently, the tilting wedge 55 resides within, and turns with, the coring bit 50 during the coring process so long as the direction of rotation of the coring bit 50 is clockwise (as shown by arrow 85), but the tilting wedge 55 is thrusted toward the distal end 72 of the coring bit 50 along an axial track within the coring bit 50 upon reversal of rotation of the coring bit 50 to rotate in the counterclockwise direction. This action can be accomplished using a cam or inclined plane machined into the interior surface of the coring bit 50 or by using a rotary screw advance mechanism.

Figure 9:
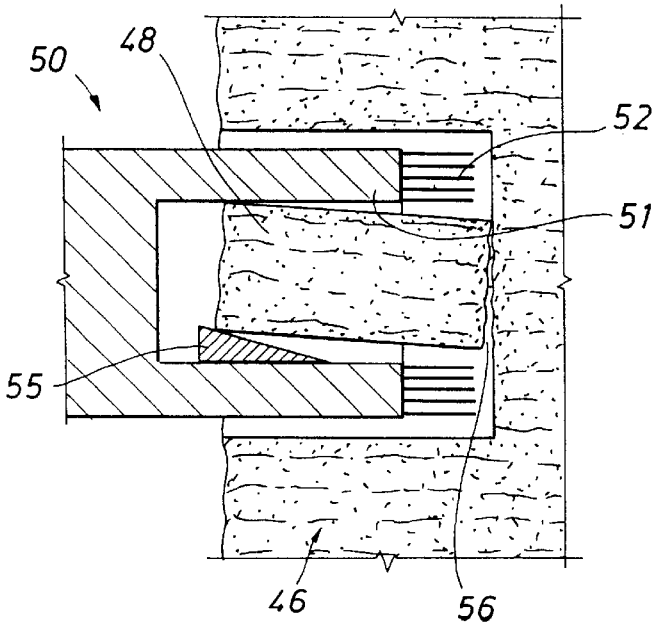
FIG. 9 shows a tilting wedge in the actuated position and breaking a cut core sample free at the interface of the core sample and the formation.

FIG. 9 shows the actuated tilting wedge 55 disposed between the exterior surface of the protruding core sample 48 and the interior wall of the coring bit 50. The actuated tilting wedge 55 urges the proximal end of the core sample 48 towards an eccentric position within the interior of the coring bit 50. Eccentric displacement of the proximal end of the core sample 48 imparts a breaking moment at the interface 56 between the core sample 48 and the formation 46. The breaking moment induced by actuation of the tilting wedge 55 causes the core sample 48 to break free from the formation 46 without tilting of the coring bit 50 or movement of the coring tool 10. The tilting wedge 55 may provide an additional benefit of securing the broken core sample 48 within the coring bit 50 between the tilting wedge 55 and the opposing interior wall of the base 51 of the coring bit 50.

The present invention also provides a core sample retaining sleeve for retaining a core sample within the coring bit and thereby preventing loss of the core sample after it is broken free from the formation. The core sample retaining sleeve prevents loss of the core sample from the open distal end of the coring bit by disposing an obstacle(s) to movement of the core sample out of the open cutting end of the coring bit. Loss of the core sample from conventional coring equipment often occurs while the coring bit is being retracted into the coring tool and away from the formation.

FIG. 10 shows a core sample retaining sleeve 60 in its simplest embodiment for active or actuated retaining finger(s). The core sample retaining sleeve 60 comprises a single actuated retainer finger 62 disposed along the interior wall of the base 51 of the coring bit 10. The retaining finger 62 is shown in contact with a push stem 64. The push stem 64 actuates the retaining finger 62 against the guide 66, which directs the retaining finger 62 into position near the distal end of the coring bit 10 to prevent loss of the core sample from the end of the coring bit. The guide 66 may be slidably attached to the coring bit 10 and actuated into position near the end of the coring bit 10 after cutting is complete. Alternatively, the guide may be formed on the inside surface of the coring bit 10.

The retaining finger 62 may be integral with the push stem 64. If the retaining finger 62 and the push stem 64 form an integral component, then proper positioning of the retaining finger 62 near the distal end of the coring bit 10 can be achieved by disposing a necked down portion 68 between the retaining finger 62 and the push stem 64. The necked down portion 68 will become the predetermined point of bending of the core sample retainer 60 having an integral retaining finger 62 and push stem 64.

The retaining finger 62 may be actuated into position to retain the core sample within the coring bit in several ways including axial displacement of the retaining finger 62 against a guide, reversal of the direction of rotation of the coring bit 10, or through the use of a hydraulic or electric actuator. Numerous types of actuators are known in the art.

In FIG. 10, the retainer finger 62 is actuated into position by axially disposing the push stem 64 in a direction parallel to the axis of the coring bit 10 with an applied actuating force 69. The applied actuating force 69 is transferred through the push stem 64 to the retainer finger 62, which is disposed against the guide or deflector 66. The push stem 64 and the retainer finger 62 may be integral or separate. More than one retaining finger may be disposed at different positions about the circumference of the coring bit 10 for improved performance. Multiple retaining fingers 62 may be simultaneously actuated using a single, circumferential tubular sleeve, or a portion of a sleeve, instead of multiple push stems 64. Having multiple retaining fingers requires multiple guides 66 or, more preferably, a circumferential guide.

The term "finger" as used herein is not meant to limit or restrict the invention to the use of long, slender members shaped like a human finger for retaining the core sample within the coring bit. The term "finger" describes a member that can be bent to impose an obstacle to movement of the core sample out of the coring bit. Retaining fingers in the present invention may be shaped for enhanced closure of the distal end of the coring bit.

FIG. 11 shows a core sample retainer 60 with two diametrically opposed, outward-acting clamshell-shaped retainer fingers 62 formed integrally with the push sleeve 64 with a necked down portion 68 disposed between the retainer fingers 62 and the push sleeve 64. The core sample retainer or sleeve 60 may be configured with a variety of retainer finger shapes and numbers. Preferably the retainer fingers are designed to provide substantial closure of the end of the retainer 60. Specifically, the retainer fingers may be outward-acting to provide closure with only an acute angle of bending or inward-acting to provide closure with an obtuse angle of bending. Preferably, the length of an inward-acting retaining finger will be less than the length of an outward-acting retaining finger. Accordingly, the retainer fingers 62 may be shaped in various ways to obtain the desired retention of the core sample within the coring bit. The shape of the retainer fingers may be modified to accommodate features of the actuator, features of the coring bit and the type of formation being cored. The term "closure" or "closed condition" as used herein means that the core sample or substantial pieces of the core sample can be physically retained, but does not mean that the retainer is sealed.

Figure 12:
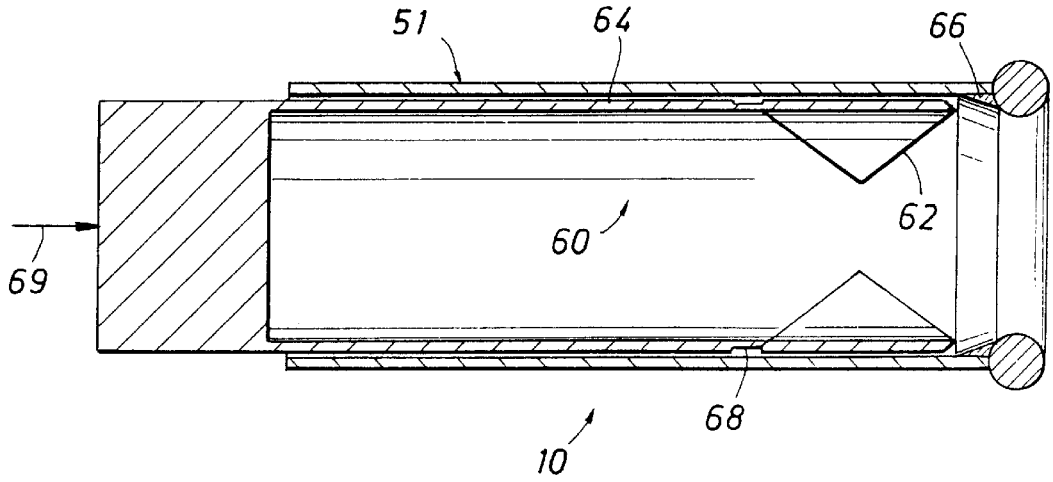
FIG. 12 shows the clam-shell type core sample retainer sleeve and integral tubular push sleeve disposed inside a coring bit prior to actuation.

FIG. 12 shows the clamshell-shaped retainer fingers 62 in an open condition, and disposed within the coring bit, before actuation of the outward-acting core sample retainer 60. Prior to actuation of the core sample retainer 60, the clamshell-shaped retainer fingers 62 and the push sleeve 64 remain disposed along the interior wall of the base 51 of the coring bit 10. The core sample retainer 60 is actuated to closure by application of the actuating force 69 to the proximal end of the push sleeve 64. The actuating force 69 is transferred through the push sleeve 64 to the clamshell shaped retainer fingers 62, which are disposed against the guides 66 at the distal end of the coring bit 10. As discussed in reference to FIG. 11, the core sample retainer is either outward-acting or inward-acting depending upon the degree that the retaining fingers are actuated or bent, which may be dictated by the length and shape of the retaining fingers themselves.

Figure 13:
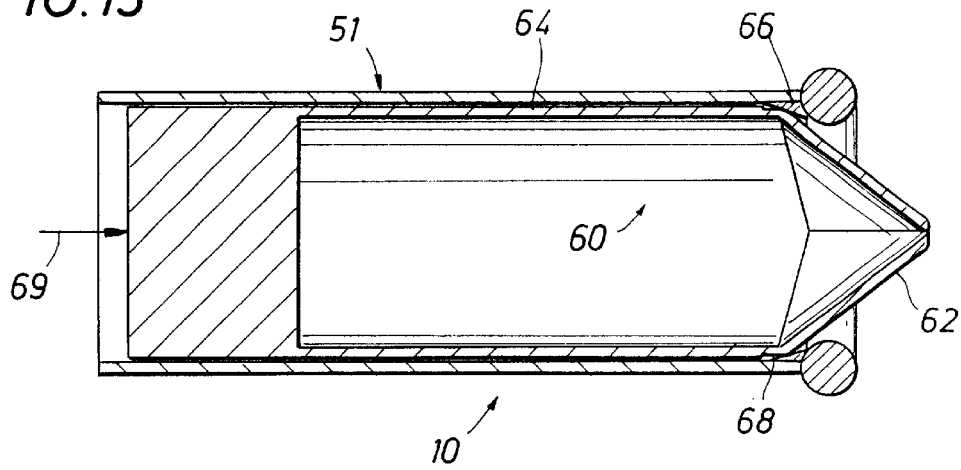
FIG. 13 shows an outward acting clam-shell type core sample retainer and integral tubular push sleeve after actuation to obtain closure at the distal end of the coring bit.

FIG. 13 shows the clamshell-shaped retainer fingers 62 in a closed condition after actuation of the outward-acting core sample retainer 60. The clamshell-shaped retainer fingers 62 provide substantial closure upon actuation to prevent loss of the core sample received within the coring bit 10.

Figure 14:
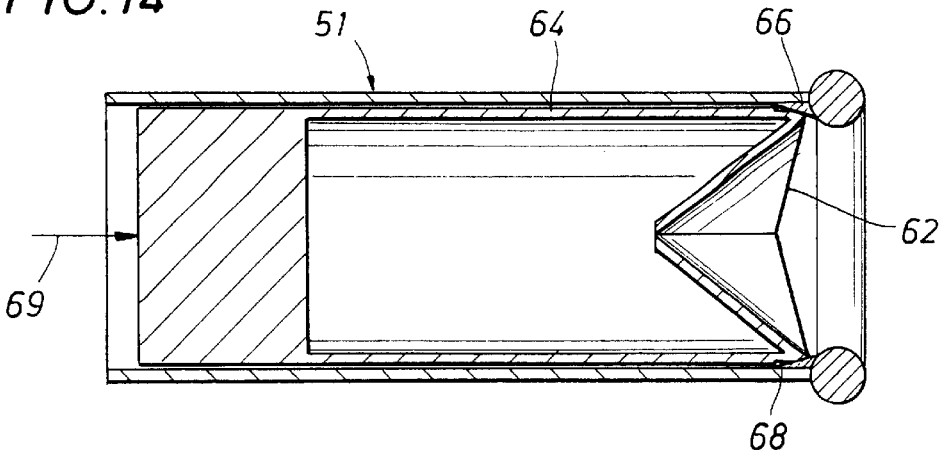
FIG. 14 shows an inward acting clam-shell type core sample retainer and integral push sleeve disposed inside a coring bit after actuation of the core sample retainer to obtain closure at the distal end of the coring bit.

FIG. 14 shows another embodiment of the invention with inward acting, rather than outward acting, clamshell-shaped retainer fingers 62. While the inward acting configuration offers less capacity within the actuated retainer fingers 62 for the core sample itself, the overall length of the coring bit 10/core sample retainer 62 is reduced.

The internal surface of the retaining sleeve may be designed to permit unidirectional travel of the cut core sample. For example, tapered grooves, protrusions or bristles angled toward the proximal end of the coring bit and radially disposed toward the center of the hollow interior of the core retaining sleeve may comprise passive, or non-actuated, fingers that would permit the core sample to be received from the distal end of the core retaining sleeve, but would prevent loss of the core sample by resisting reverse movement of the core sample back towards the open cutting end of the coring bit. These grooves, protrusions or bristles may also be arranged in a pattern to promote removal of drill cuttings and debris from the cutting zone during cutting of the core sample, or they may be superimposed upon other grooves or channels designed for that purpose.

If the tilting wedge and core retaining sleeve are used in the same device, then they would be used sequentially or simultaneously, with the tilting wedge used first to break the core free then the core retaining sleeve used to capture the core. While the tilting wedge will typically be actuated and withdrawn before actuating the core retaining sleeve, it is preferred that the core retaining sleeve be positioned around the core and ready to actuate the retaining finger(s) at the time that the tilting wedge breaks the core free. To accomplish this, the core retaining sleeve may be disposed between the inside wall of the coring bit and the tilting wedge. In this manner, the sleeve is positioned against the guide, the tilting wedge is actuated to break the core free, the tilting wedge is withdrawn, and the core retaining sleeve actuated to close the retaining fingers and secure the core sample.

While the foregoing is directed to the preferred embodiment of the present invention, other and further embodiments of the invention may be devised without departing from the basic scope thereof, and the scope thereof is determined by the claims which follow.

We claim:

1. An apparatus for obtaining a core sample comprising:

a coring bit extendible into the sidewall of a wellbore, the coring bit having an interior wall and one or more stationary guide members formed on a distal end of the interior wall;

a core retaining sleeve in concentric alignment within the coring bit, at least a portion of the sleeve defining one or more closeable retaining fingers at a distal end thereof and integral therewith, the sleeve defining a chamber for storing the core sample; and an actuator for forcing the one or more closeable retaining fingers against the one or more stationary guide members to radially deflect the retaining fingers to a closed position.

2. The apparatus of claim 1, wherein the one or more closeable retaining fingers each have a predefined hinge point.

3. The apparatus of claim 1, wherein the number of retainer fingers is two.

4. The apparatus of claim 1, wherein the retaining fingers are shaped to substantially close the distal end of the core retaining sleeve upon radial deflection.

5. The apparatus of claim 1, further comprising:

a tilting wedge aligned with the interior wall of the coring bit; and an actuator for forcing the tilting wedge between the interior wall of the core retaining sleeve and the core sample to tilt the core sample whereby the core sample is detached from the wellbore sidewall.

6. A method for obtaining core sample, comprising:

(a) cutting the core sample in a sidewall of a wellbore using a coring bit;

(b) disposing a core retaining sleeve around the core sample;

(c) advancing a tilting wedge between the sidewall and the core sample whereby the sample is detached from the sidewall; and (d) capturing the core sample within the core retaining sleeve.

7. The method of claim 6, wherein the core retaining sleeve comprises one or more retaining fingers formed on a distal end of the core retaining sleeve, and wherein the step of capturing the core sample comprises closing the one or more retaining fingers.

8. The method of claim 7, wherein the one or more retaining fingers are closed by urging the one or more retaining fingers against one or more guide members.

9. The method of claim 8, wherein the guide members are formed on an inner surface of a coring bit used for cutting the core sample.

10. The method of claim 6, further comprising repeating steps (a) through (d) at other locations in the wellbore using additional core retaining sleeves in the coring bit.

11. The method of claim 6, wherein the core sample is cut with an extendable coring bit, further comprising:

(e) retracting the coring bit and core retaining sleeve containing the core sample.

12. An apparatus for obtaining a core sample from a wellbore sidewall comprising:

a coring bit having an interior wall defining a chamber for receiving the core sample;

a tilting wedge positioned adjacent to the interior wall of the coring bit; and an actuator for advancing the wedge along the interior wall of the coring bit between the interior wall of the coring bit and the core sample to tilt the core sample whereby the core sample is detached from the wellbore sidewall.

13. An apparatus for obtaining a core sample comprising:

a coring bit extendable into the sidewall of a wellbore, the coring bit having an interior wall and one or more stationary guide members formed on the distal end of the interior wall;

at least one core retaining sleeve in concentric alignment within the coring bit, at least a portion of the sleeve defining one or more closeable retaining fingers at a distal end thereof and integral therewith, the sleeve defining a chamber for storing the core sample; and an actuator for forcing the one or more closeable retaining fingers against the one or more stationary guide members to radially deflect the retaining fingers to a closed position.

* * * * *